US007686273B2

(12) United States Patent
Christodoulou

(10) Patent No.: US 7,686,273 B2
(45) Date of Patent: Mar. 30, 2010

(54) METHOD AND DEVICE FOR AN ADJUSTABLE HANGER

(76) Inventor: James Christodoulou, 1500 Hudson St., Hoboken, NJ (US) 07030

( * ) Notice: Subject to any disclaimer, the term of this patent is extended or adjusted under 35 U.S.C. 154(b) by 510 days.

(21) Appl. No.: 11/592,522

(22) Filed: Nov. 3, 2006

(65) Prior Publication Data

US 2008/0105812 A1 May 8, 2008

(51) Int. Cl.
*A47G 1/24* (2006.01)

(52) U.S. Cl. ..... 248/476; 248/489; 248/295.11; 248/495; 248/497

(58) Field of Classification Search ..... 248/476, 248/475.1, 477, 478, 482, 489, 493, 495, 248/497, 466, 295.11, 216.4, 304, 547, 322, 248/323, 327, 339; 40/759
See application file for complete search history.

(56) References Cited

U.S. PATENT DOCUMENTS

| | | | | | |
|---|---|---|---|---|---|
| 150,230 | A | | 4/1874 | Dobbs et al. | |
| 1,196,936 | A | | 9/1916 | Elsass et al. | |
| 1,794,327 | A | | 2/1931 | Simon | |
| 1,974,855 | A | | 9/1934 | Slaght | |
| 2,509,424 | A | | 5/1950 | Denton | |
| 2,522,901 | A | * | 9/1950 | Schrager et al. | 248/495 |
| 2,546,359 | A | | 3/1951 | Emrick | |
| 2,697,572 | A | * | 12/1954 | Pfankuch | 248/495 |
| 2,723,096 | A | | 11/1955 | Schwartz | |
| 2,939,661 | A | | 6/1960 | Waller et al. | |
| 2,965,339 | A | | 12/1960 | Denton | |
| 2,981,506 | A | | 4/1961 | Saslow | |
| 3,861,631 | A | | 1/1975 | Shorin | |
| 4,566,665 | A | * | 1/1986 | Rynearson | 248/495 |
| 4,610,419 | A | | 9/1986 | Swanson | |
| 4,611,779 | A | | 9/1986 | Leonard, Jr. | |
| 4,892,284 | A | | 1/1990 | Kelrick | |
| 5,584,462 | A | * | 12/1996 | Reese | 248/477 |
| 5,806,826 | A | | 9/1998 | Lemire | |
| 5,878,987 | A | * | 3/1999 | Hayde | 248/477 |
| 6,398,174 | B1 | | 6/2002 | Emalfarb | |
| 6,663,075 | B2 | | 12/2003 | Zuller | |
| 6,666,425 | B1 | | 12/2003 | Ferguson | |
| 6,739,065 | B2 | | 5/2004 | Hofmeister et al. | |
| 7,201,357 | B2 | * | 4/2007 | Price et al. | 248/477 |

(Continued)

FOREIGN PATENT DOCUMENTS

GB 2 221 616 A 2/1990

OTHER PUBLICATIONS

International Search Report and Written Opinion dated May 23, 2008 for PCT/US2007/83610.

(Continued)

*Primary Examiner*—J. Allen Shriver
*Assistant Examiner*—Todd M. Epps
(74) *Attorney, Agent, or Firm*—Kenyon & Kenyon LLP

(57) ABSTRACT

Methods and devices are for adjustably and securely supporting an object using an adjustable hanger. The hanger includes a movable bracket, a fastener extending through the bracket and an adjustment member engaging the bracket and engaging the fastener. Adjustment of the adjustment member adjusts the position of the hanger relative to the fastener and to the surface to which the fastener attaches the hanger to the surface. Thus, a position of an object hung by the hanger is adjustable.

19 Claims, 2 Drawing Sheets

U.S. PATENT DOCUMENTS

| | | | | |
|---|---|---|---|---|
| 7,497,411 | B2 * | 3/2009 | Weck et al. | 248/480 |
| 7,578,492 | B2 * | 8/2009 | Darre' | 248/477 |
| 2005/0242265 | A1 | 11/2005 | Huang | |
| 2006/0060748 | A1 | 3/2006 | Darre | |

OTHER PUBLICATIONS

Right Height Picture Hanger, RH™ (U.S. Patent 6,663,075, Model No. 1121), Right Height Products, Inc., Great Neck, NY 11023 (see attached photos).

* cited by examiner

METHOD AND DEVICE FOR AN ADJUSTABLE HANGER

FIELD OF THE INVENTION

The present invention relates generally to hangers. More particularly, the present invention relates to a method and device for an adjustable hanger.

BACKGROUND INFORMATION

The hanging of objects, such as pictures, is accomplished most often by the use of a stationary metal hook having a vertical shank with a nail holder at the top of the shank. The nail holder permits a nail to be driven into the wall thereby fixing the metal hook in place. In order to obtain the exact desired position of the object, e.g., with respect to adjacent hanging objects or fixed objects on a wall, a precise alignment of the hanger is required. For example, when hanging two or more pictures side-by-side, precise alignment, e.g., vertically, of the pictures is required for aesthetic reasons. Thus, precise alignment of hangers for hanging the pictures is generally required. When a misalignment occurs, it is often necessary to remove and reposition the hook, thereby creating a new hole and leaving an unsightly empty hole in the wall. This trial-and-error approach, particularly when hanging objects in walls formed of gypsum board, may results in a loss of structural integrity of the portion of the wall in the vicinity of the multiple holes. When hanging an object that, due to, e.g., weight, width, etc., requires multiple hangers, alignment may be even more problematic than an object that only requires a single hanger. Based on the foregoing, it should be apparent that adjustment of the position of conventional hanging devices may be cumbersome, inconvenient, error prone, and time consuming.

Existing adjustable hangers are believed to include multi-component mechanisms that are complicated to use and costly to produce. Thus, there is believed to be a need for an adjustable hanger device that is easier to use and less costly to produce than existing hangers.

SUMMARY

According to an example embodiment of the present invention, an adjustable hanger for hanging an object on a surface includes: a bracket including a portion adapted to engage the object and at least one guideway; a fastener extendable through the guideway and adapted to attach the bracket to the surface movably with respect to the surface; and an adjustment member in engagement with the bracket and adapted to engage the fastener. Adjustment of the adjustment member effects an adjustment of a distance between the fastener and the portion.

The portion may be generally hook shaped.

The portion may include a transverse groove adapted to receive and support at least one of (a) a wire and (b) a cable.

The bracket may include a plurality of portions adapted to engage an object.

The bracket may include at least two portions adapted to engage the object, and a distance between the portions may be less than or equal to a maximum adjustability of the bracket with respect to the surface.

The bracket may be fabricated from a single bent metal strip.

The bracket may include a threaded aperture, and the adjustment member may be threadedly received in the threaded aperture. The bracket may include a first portion including one of at least two guideways, a second portion at a substantially right angle to the first portion and including the threaded aperture, and a third portion opposite the first portion and including another one of the at least two guideways.

The first portion, the second portion and the third portion may form a substantially triangular shape.

The third portion may be substantially parallel to the first portion.

The fastener may be drivable into the surface through the guideway at least one of (a) perpendicular and (b) non-perpendicular to the surface.

The fastener may include one of (a) a nail and (b) a screw.

The adjustment member may include at least one of (a) a screw and (b) a bolt.

The bracket may be fabricated from a polymeric material.

The bracket may be injection molded.

The at least one guideway may include a plurality of guideways, and the fastener may be extendable through the guideways.

The guideway may be arranged as an elongated slot.

The surface may be substantially vertical.

Adjustment of the adjustment member may effect the adjustment of the distance between the fastener and the portion in a direction substantially parallel to the surface.

According to an example embodiment of the present invention, a system includes: a hangable object; and an adjustable hanger as described above.

According to an example embodiment of the present invention, a method includes: attaching a bracket of an adjustable hanger to a surface with a fastener, the bracket including a portion adapted to engage an object to the hung on the surface by the hanger; engaging the fastener with an adjustment member of the hanger; and adjusting a position of the portion of the bracket relative to at least one of (a) the fastener and (b) the surface in accordance with adjustment of the adjustment member.

The position of the bracket may be adjusted in the adjusting step in a direction substantially parallel to the surface.

The method may include hanging the object on the bracket after the adjusting step.

Example embodiments of the present invention are described in more detail below with reference to the appended Figures.

DETAILED DESCRIPTION

Figure 1:
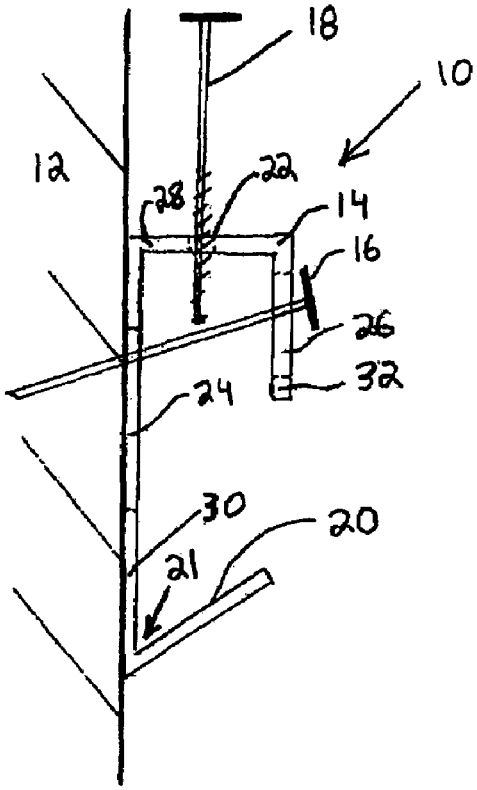
FIG. 1 is a side view of an adjustable hanger mounted on a section of a wall.

FIG. 1 illustrates an adjustable hanger 10 mounted on a section of a generally vertical surface 12, e.g., a wall. While FIG. 1 illustrates surface 12 as a wall and generally vertical, surface 12 may be any type of surface that is capable of receiving adjustable hanger 10. Adjustable hanger 10 includes movable bracket 14, a stationary fastener 16, e.g., a nail, a screw, etc., and a threaded adjustable member 18.

Figure 5:
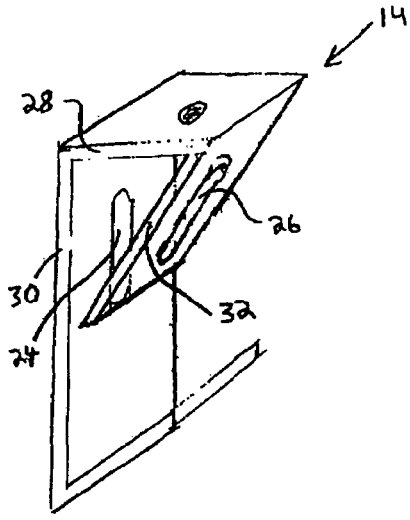
FIG. 5 is a perspective view of a movable bracket of an adjustable hanger.

Movable bracket 14 includes a portion 20 capable of receiving an object, a generally vertical portion 30 having a guideway 24, a generally horizontal portion 28 having a threaded aperture 22 and a portion 32 opposite the generally vertical portion 30 having another guideway 26. Guideways 24, 26 are adapted to receive the fastener 16 therethrough to fasten the hanger 10 to the surface 12. The guideways 24, 26 are generally aligned. Portions 30, 28 and 32 are illustrated at substantially right angles with respect to each other but may also be formed in the shape of a triangle (as illustrated in FIG. 5) or other configurations such that guideways 24, 26 are generally aligned and arranged to receive stationary fastener 16. As described below, either one or both of guideways 24, 26 may be elongated so that the bracket 14 may be movable, e.g., vertically, with respect to the surface 12 or fastener 16 to provide for, e.g., vertical, adjustment of the object 36.

The portion 20 capable of receiving an object 36 may be formed at an acute angle with respect to the vertical portion 30 so that the object 36 may be secured to the hanger 10. It forms an upwardly facing groove 21, e.g., in the general shape of a hook. Groove 21 may be sized to receive and support a frame-hanging wire or cable. The portion 20 may also be formed in any general shape that is capable of receiving and supporting an object.

Fastener 16 extends through guideways 24 and 26 and attaches bracket 14 to generally vertical surface 12. When attached, the bracket 14 is movable, e.g., vertically, relative to the surface 12. Fastener 16 may be a nail, a screw or other member suitable for movably securing movable bracket 14 to generally vertical surface 12. Fastener 16 securely attaches movable bracket 14 to generally vertical surface 12 while at the same time permitting the movement of movable bracket 14, e.g., by virtue of the guideways 24, 26 being elongated in the vertical direction. Guideways 24, 26 are aligned such that fastener 16 is driven into generally vertical surface 12 at an angle, i.e., non-perpendicularly, to the surface 12. Guideways 24, 26 may, however, permit stationary fastener 16 to be driven into surface 12 perpendicularly thereto.

Threaded adjustment member 18 threadedly engages threaded aperture 22 and is rotated such that it extends through threaded aperture 22 and contacts stationary fastener 16. Threaded adjustable member 18 is illustrated as a threaded bolt but may be a screw or other member capable of engaging threaded aperture 22 and engaging fastener 16 or otherwise engaging fastener 16 and bracket 14 so that adjustment of adjustment member 18 correspondingly adjusts bracket relative to fastener 16 to adjust positioning of the portion 20 relative to the fastener 16. For example, turning adjustment member 18 causes adjustment member 18 to assert a force against fastener 16 thereby causing movable bracket 14 to move relative to fastener 16 and surface 12 in, e.g., a generally vertical direction. The end of adjustment member 18 may include a surface, such as a flattened area or a bulb for improving the engagement of adjustment member 18 with fastener 16. Fastener 16 may include a surface, such as an enlarged flattened area or a crevice (for receiving a bulb), for engaging the end of adjustment member 18. Turning or otherwise adjusting adjustment member 18 allows for the adjustment of bracket 14 to a desired position.

Movable bracket 14 may be fabricated of metals, polymeric plastic materials, and/or any other suitable material having sufficient strength to accommodate the load of an object to be supported. For example, metals such as brass, aluminum, steel, etc., may be used. Also, plastics or composite materials may be used. FIG. 1 illustrates bracket 14 formed from a single bent metal strip but it may also consist of individual interconnected members. Where a plastic material is utilized, movable bracket 14 may be fabricated using, e.g., an injection, molding process.

Figure 2:
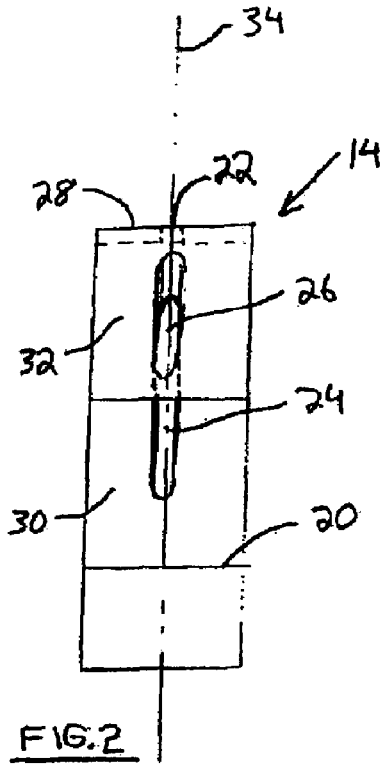
FIG. 2 is a front view of a movable bracket of the adjustable hanger illustrated in FIG. 1.

FIG. 2 is a front view of bracket 14. Guideways 24, 26 are aligned for receiving fastener 16. Bracket 14 is generally symmetrical about plane 34 passing through axes of threaded aperture 22 and guideways 24, 26.

Figure 3:
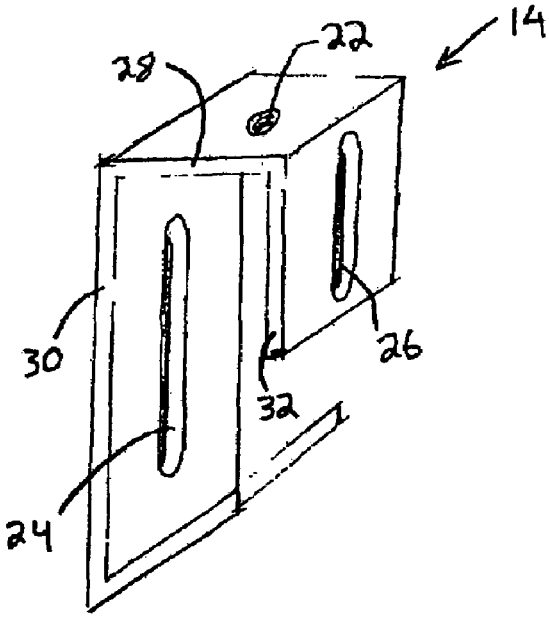
FIG. 3 is a perspective view of the movable bracket illustrated in FIGS. 1 and 2.

FIG. 3 is an isometric view of the bracket 14 illustrated in FIGS. 1 and 2.

Figure 4:
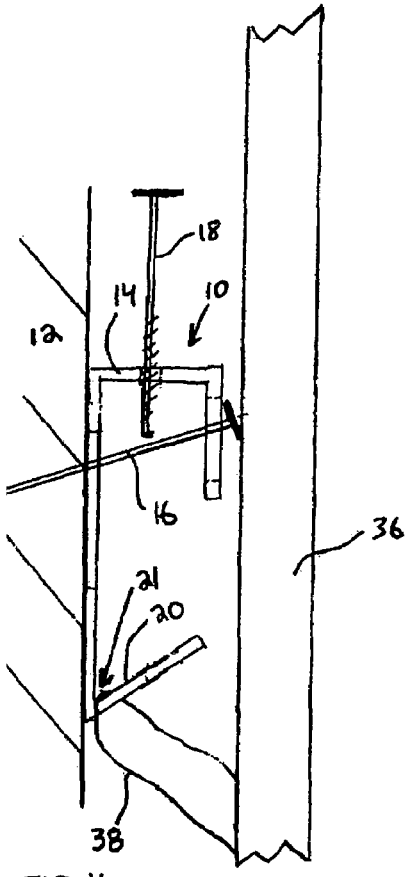
FIG. 4 is a side view of an adjustable hanger mounted on a section of a wall with an object supported by the adjustable hanger.

FIG. 4 is a side view of adjustable hanger 10 mounted on a section of generally vertical surface 12 with an object 36, e.g., a picture (only a fragment portion of the picture is illustrated) supported by adjustable hanger 10. Object 36 has a hanging wire 38 that engages portion 20 and rests in upwardly facing groove 21 of bracket 14. Turning or adjusting adjustment member 18 allows for the adjustment of bracket 14 to a desired position relative to the fastener 16, thereby adjusting the position of object 36 relative to fastener 16 or surface 12.

FIG. 5 is a perspective view of bracket 14 with portions 28, 30, 32 forming a substantially triangular shape.

Figure 6:
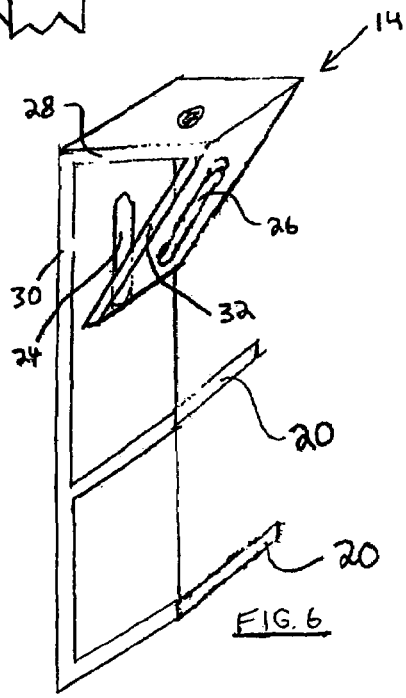
FIG. 6 is a perspective view of a movable bracket of an adjustable hanger with two portions adapted to engage an object.

FIG. 6 is a perspective view of movable bracket 14 of adjustable hanger 10 with two portions 20 adapted to engage an object or objects. The distance between the two portions 20 is less than or equal to the maximum distance bracket 14 is capable of moving with respect to a surface. The maximum distance bracket 14 is capable of moving is the distance that guideways 24, 26 permit bracket 14 to move along the surface when bracket 14 is movable attached to the surface by fastener 16. Although, bracket 14 is shown with two portions 20, additional portions may be provided. Thus, e.g., if the bracket has two portions and is capable of moving over a range of ½", the distance between the two portions is less than or equal to ½", thereby permitting overall adjustability of approximately 1". If additional portions are provided (e.g., a third, fourth, fifth, etc. portion), each additional portion is spaced at a distance less than or equal to ½" from the previous portion. By arranging each portion at a distance of less than or equal to the maximum distance the bracket is capable of moving, the object may be continuously or infinitely adjustable or positioned within the extended range provided by each additional portion.

Additionally, bracket 14 may include multiple portions 20 arranged in various configurations, i.e. configurations not necessarily limited by a distance of less than or equal to the maximum distance the bracket is capable of moving. Each additional portion included on bracket 14 would allow for the placement of an object or objects at different positions thereby increasing the range available for locating and adjusting an object or objects.

Adjustable hanger 10 may be utilized for adjustably and securely supporting an object by attaching bracket 14 to surface 12 using fastener 16 and adjusting bracket 14 utilizing adjustment member 18 that, e.g., threadedly, engages bracket 14 and engages fastener 16 thereby asserting a force against fastener 16. Adjustment of adjustment member 18 causes bracket 14 to move relative to fastener 16 and surface 12.

What is claimed is:

1. An adjustable hanger for hanging an object on a surface, comprising:

a bracket including a portion adapted to engage the object and at least one guideway;

a fastener extendable through the guideway and adapted to attach the bracket to the surface movably with respect to the surface; and an adjustment member in engagement with the bracket and adapted to engage the fastener;

wherein adjustment of the adjustment member effects an adjustment of a distance between the fastener and the portion.

2. The hanger according to claim 1, wherein the portion is generally hook shaped.

3. The hanger according to claim 1, wherein the portion includes a transverse groove adapted to receive and support at least one of (a) a wire and (b) a cable.

4. The hanger according to claim 1, wherein the bracket includes a plurality of portions adapted to engage the object.

5. The hanger according to claim 1, wherein the bracket includes at least two portions adapted to engage the object, a distance between the portions less than or equal to a maximum adjustability of the bracket with respect to the surface.

6. The hanger according to claim 1, wherein the bracket is fabricated from a single bent metal strip.

7. The hanger according to claim 1, wherein the bracket includes a threaded aperture, the adjustment member threadedly received in the threaded aperture, the bracket including a first portion including one of at least two guideways, a second portion at a substantially right angle to the first portion and including the threaded aperture, and a third portion opposite the first portion and including another one of the at least two guideways.

8. The hanger according to claim 7, wherein the first portion, the second portion and the third portion form a substantially triangular shape.

9. The hanger according to claim 7, wherein the third portion is substantially parallel to the first portion.

10. The hanger according to claim 1, wherein the fastener is drivable into the surface through the guideway at least one of (a) perpendicular and (b) non-perpendicular to the surface.

11. The hanger according to claim 1, wherein the fastener includes one of (a) a nail and (b) a screw.

12. The hanger according to claim 1, the adjustment member includes at least one of (a) a screw and (b) a bolt.

13. The hanger according to claim 1, wherein the bracket is fabricated from a polymeric material.

14. The hanger according to claim 1, wherein the bracket is injection molded.

15. The hanger according to claim 1, wherein the at least one guideway includes a plurality of guideways, the fastener extendable through the guideways.

16. The hanger according to claim 1, wherein the guideway is arranged as an elongated slot.

17. The hanger according to claim 1, wherein the surface is substantially vertical.

18. The hanger according to claim 1, wherein adjustment of the adjustment member effects the adjustment of the distance between the fastener and the portion in a direction substantially parallel to the surface.

19. A system, comprising:

a hangable object; and an adjustable hanger adapted to hang the object on a surface, the hanger including:

a bracket including a portion adapted to engage the object and at least one guideway;

a fastener extendable through the guideway and adapted to attach the bracket to the surface movably with respect to the surface; and an adjustment member in engagement with the bracket and adapted to engage the fastener;

wherein adjustment of the adjustment member effects an adjustment of a distance between the fastener and the portion.

* * * * *